US005443787A

United States Patent [19]

Mori et al.

[11] Patent Number: 5,443,787

[45] Date of Patent: Aug. 22, 1995

[54] METHOD FOR PREPARING IRON SYSTEM SOFT MAGNETIC SINTERED BODY

[75] Inventors: Teruo Mori; Norishige Yamaguchi, both of Chiba; Katsuhiko Wakayama, Ibaraki, all of Japan

[73] Assignee: TDK Corporation, Tokyo, Japan

[21] Appl. No.: 274,451

[22] Filed: Jul. 13, 1994

[30] Foreign Application Priority Data

Jul. 13, 1993 [JP] Japan ..... 5-195337

[51] Int. Cl.[6] ..... B22F 1/00; B22F 31/2; B22F 9/04

[52] U.S. Cl. ..... 419/32; 419/10; 419/38; 419/53; 419/58

[58] Field of Search ..... 419/10, 32, 38, 53, 419/58

[56] References Cited

U.S. PATENT DOCUMENTS

| | | | |
|---|---|---|---|
| 3,844,847 | 10/1974 | Bomford et al. | 148/11.5 F |
| 3,909,309 | 9/1975 | Bomford | 148/11.5 F |
| 4,518,427 | 5/1985 | Tengzelius et al. | 75/251 |
| 4,925,502 | 5/1990 | Yamagishi et al. | 148/311 |
| 5,002,728 | 3/1991 | Achikita et al. | 419/23 |
| 5,067,979 | 11/1991 | Kiyota et al. . | |
| 5,091,022 | 2/1992 | Achikita et al. | 148/104 |
| 5,098,648 | 3/1992 | Kiyota et al. | 419/23 |
| 5,147,601 | 9/1992 | Ohtsuka et al. | 419/25 |
| 5,284,615 | 2/1992 | Ueda et al. | 419/37 |

FOREIGN PATENT DOCUMENTS

| | | | |
|---|---|---|---|
| 3-2349 | 1/1991 | Japan . | |
| 4-99247 | 3/1992 | Japan | C22C 33/02 |
| 5-47537 | 2/1993 | Japan . | |

*Primary Examiner*—Donald P. Walsh
*Assistant Examiner*—Scott T. Bluni
*Attorney, Agent, or Firm*—Oblon, Spivak, McClelland, Maier, & Neustadt

[57] ABSTRACT

An iron system soft magnetic sintered body is prepared by blending an iron powder with a powder of a metal or ferroalloy so as to give a desired chemical composition and subjecting the blend to mechanical alloying, thereby alloying at least a portion of the metal or ferroalloy with iron, followed by shaping and firing. Alternatively, the same is prepared by treating an iron system alloy powder of a desired chemical composition by a mechanical grinding process, followed by shaping and firing. Even when starting with relatively large mean particle size powder, the resulting sintered body has a high density and improved magnetic properties.

20 Claims, 2 Drawing Sheets

METHOD FOR PREPARING IRON SYSTEM SOFT MAGNETIC SINTERED BODY

BACKGROUND OF THE INVENTION

This invention relates to a method for preparing an iron system soft magnetic sintered body.

PRIOR ART

One of known methods for preparing iron system soft magnetic sintered bodies is a powder metallurgy method including mixing of source powders, shaping and firing steps. Preparation of iron system soft magnetic sintered bodies by such powder metallurgy has the advantages of reduced amounts of cutting waste, possibility of complex shaping and reduced costs as compared with the conventional machining of strip materials, and now finds increasing use as parts in business machines, motors and automobiles.

Several problems, however, arise in preparing soft magnetic sintered bodies of high density and excellent properties by powder metallurgy. One problem is the need to use materials of high purity and controlled particle size. Such materials are expensive, susceptible to oxidation, and difficult to manage. As a general rule, materials commonly used have a mean particle size of about 150 μm. Use of such materials, however, leads to a density of about 80 to 93% after sintering. To provide a higher density, high pressure molding and high temperature firing are necessary.

SUMMARY OF THE INVENTION

Therefore, an object of the present invention is to provide a method capable of firing a source powder having a relatively large mean particle size into an iron system soft magnetic sintered body with a high density and improved performance.

In a first form, the present invention provides a method for preparing an iron system soft magnetic sintered body comprising the steps of: blending an iron powder with at least one metal powder selected from metals to be alloyed with iron and ferroalloys so as to give a desired chemical composition; treating the blend by a mechanical alloying process, thereby alloying at least a portion of the metal or ferroalloy with iron; shaping the blend into a compact; and firing the compact into an iron system soft magnetic sintered body.

In a second form, an iron system soft magnetic sintered body is prepared by a method comprising the steps of: treating an iron system alloy powder of a desired chemical composition by a mechanical grinding process; shaping the powder into a compact; and firing the compact into an iron system soft magnetic sintered body.

In one preferred embodiment, the chemical composition is any of the followings: a Fe-Si system containing 2 to 7% by weight of silicon, a Fe-P system containing 0.2 to 1% by weight of phosphorus, a Fe-Cr system containing 10 to 20% by weight of chromium, a Fe-Co system containing 25 to 60% by weight of cobalt, a Fe-Co-V system containing 25 to 60% by weight of cobalt and 0.5 to 5% by weight of vanadium, a Fe-Ni system containing 30 to 60% by weight of nickel, and a Fe-Ni-Mo system containing 70 to 85% by weight of nickel and 0.5 to 5% by weight of molybdenum.

The preferred iron powder consists of iron particles flattened by a mechanical alloying process, especially a thickness to major length ratio of 1/500 to 1/5 as measured by SEM observation.

In a preferred embodiment, the treatment by a mechanical alloying process is effected in the presence of a solid lubricant. The solid lubricant is stearic acid, a salt or derivative thereof, or wax and is added in an amount of 0.1 to 5% by weight of the alloying material.

In another preferred embodiment, carbon is added in an amount of up to 0.5% by weight of the alloying material before or during the treatment. The carbon is amorphous carbon and is in powder form having a mean particle size of up to 50 μm.

Usually the firing step includes a heating step and a temperature holding step. The firing is preferably effected in a reducing atmosphere for at least a portion of the time span from the point in a later stage of the heating step when a temperature of 1,050° C. is reached to the end of the temperature holding step and in an inert atmosphere in a time region of the heating step prior to said portion. The preferred reducing atmosphere is an atmosphere containing at least 1% of $H_2$ or an ammonia decomposed gas atmosphere containing at least 10% of $H_2$.

Also contemplated herein is an iron system soft magnetic sintered body which is prepared by the method of the invention.

According to the first form of the inventive method, an iron system soft magnetic sintered body is prepared by blending an iron powder with a metal or ferroalloy powder and subjecting the blend to mechanical alloying, thereby alloying at least a portion of the metal or ferroalloy with iron so that an iron system amorphous alloy or an iron system metastable phase alloy is once formed. The material is then shaped and fired into an iron system soft magnetic sintered body having crystallinity. The second form of the inventive method uses an iron system alloy powder of a desired chemical composition from the first. The powder is treated by a mechanical grinding process so as to induce appropriate internal strains in the powder and activate the surface. The powder is then shaped and fired into an iron system soft magnetic sintered body having crystallinity. In either case, even when started with a source material having a relatively large mean particle size, the method results in an iron system soft magnetic sintered body of high density and improved performance.

Japanese Patent Application Laid-Open (JP-A) No. 99247/1992 discloses the technique for preparing soft magnetic alloy powder by mechanical alloying and grinding processes. This technique requires that the alloy powder be shaped and consolidated into a part of desired shape by hot extrusion, and in this regard, it is a contrast to the present invention involving firing.

DETAILED DESCRIPTION OF THE INVENTION

Figure 1:
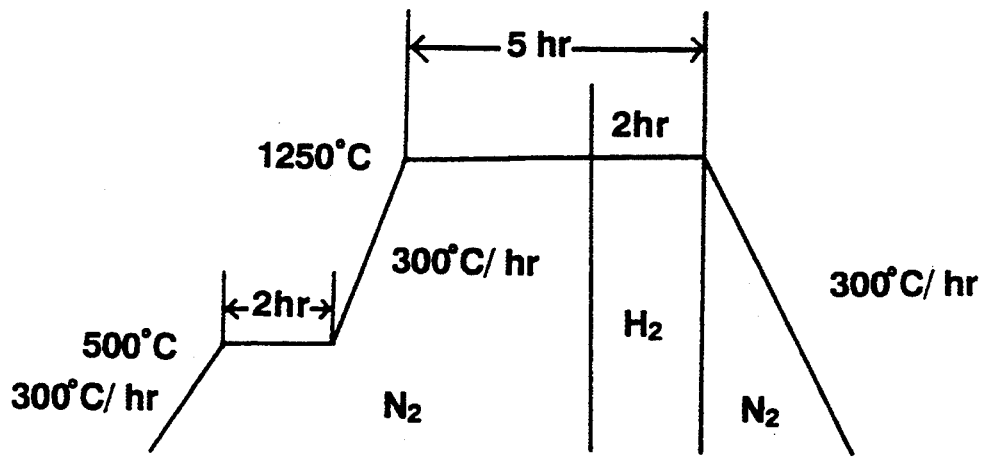
FIG. 1 is a time chart illustrating one exemplary firing temperature profile according to the present invention.

In the first form of the inventive method, an iron system soft magnetic sintered body is prepared by blending an iron powder with at least one metal powder so as to give a desired chemical composition. The metal powder used herein is a metal to be alloyed with iron or a ferroalloy. The desired chemical composition is, for example, a Fe-Si system containing 2 to 7% by weight of silicon, a Fe-P system containing 0.2 to 1% by weight of phosphorus, a Fe-Cr system containing 10 to 20% by weight of chromium, a Fe-Co system containing 25 to 60% by weight of cobalt, a Fe-Co-V system containing 25 to 60% by weight of cobalt and 0.5 to 5% by weight of vanadium, a Fe-Ni system containing 30 to 60% by weight of nickel, or a Fe-Ni-Mo system containing 70 to 85% by weight of nickel and 0.5 to 5% by weight of molybdenum. In particular, a Fe-Si material containing 6.0 to 7.0% by weight of silicon is minimized in loss and magnetostriction and thus effective for reducing beat or noise when used as motor and display parts.

One of the source powders used herein is pure iron powder. The other source powder is a ferroalloy powder, for example, ferrosilicon, ferrophosphorus, ferrochromium, ferrocobalt, ferrovanadium, ferronickel, and ferromolybdenum in powder form. Also useful are pure metal powders, for example, pure powders of silicon, phosphorus, chromium, cobalt, vanadium, nickel, and molybdenum. For efficient processing and availability, inexpensive ferroalloy powders are desired.

While the first form of the invention uses pure iron and pure metals or ferroalloys, the second form uses an alloy of the desired chemical composition.

The starting iron powder preferably has a mean particle size of about 10 to about 150 μm. According to the invention, even when an iron powder having a relatively large mean particle size of, for example, about 150 μm is used at the start, there is achieved a sintered density equivalent to that available with the use of a starting powder having a relatively small mean particle size of, for example, about 10 μm.

The powder of the metal or ferroalloy to be alloyed with iron should preferably have a mean particle size of up to about 150 μm. The lower limit is not critical although it is generally about 10 μm as in the case of iron powder.

The thus furnished source powder, which is either a mixture of iron and a metal or ferroalloy or an alloy of desired chemical composition, is then treated by a mechanical alloying process or mechanical grinding process, obtaining a desired alloy powder. In the first form, at least a part of the metal or ferroalloy is alloyed with the iron and there is obtained a partially or fully alloyed powder.

Both the mechanical alloying and grinding processes (which are sometimes abbreviated as MA and MG, hereinafter) are to impart physical action to the source powder to induce internal strains therein and to activate the surface. The mechanical alloying process is also effective for alloying two or more elements in powder form.

Typical MA or MG treatment uses a dry attritor or media agitating mill which is operated, for example, under a nitrogen or argon atmosphere at 100 to 300 rpm for about 10 to 240 minutes. Alternatively, a dry vibratory mill, dry ball mill or the like may be used for the MA or MG treatment.

In either MA or MG treatment, the material can be too much contaminated from the atmosphere if the treatment is continued beyond an appropriate necessary time. Then the treating time which depends on the size, hardness and other factors of metal or alloy powder is often in the range of about 10 to about 240 minutes for both mechanical alloying and grinding.

Treatment by a mechanical alloying process entails alloying. Since the Curie point of Fe becomes broad as a result of alloying, alloying can be monitored by measuring an endothermic peak by a differential scanning calorimeter (DSC). Fe has a Curie point of 780° C. and ordinary iron materials have a Curie point peak half-value width in the range of about 10° to 25° C. while mechanical alloying increases the half-value width by a factor of about 2 or 3 to the range of about 20° to 75° C.

Treatment by a mechanical grinding process induces internal strains in the alloy powder which can be measured by X-ray diffractometry. Various methods are known for the quantitation of strain by X-ray diffractometry. One useful method is Warren and Aberbach's separation of crystallite size and strain by Fourier analysis (see J. Appl. Phys., Vol. 21, pp. 595 (1950)). On actual measurement, the internal strain is of the order of at least 0.005, especially 0.01 to 1.0, further especially 0.1 to 1.0.

During mechanical alloying, iron particles are flattened. The degree of flattening is preferably controlled such that flattened particles may have an average thickness to major length ratio of 1/500 to 1/5 as measured by scanning electron microscope (SEM) observation. A lower degree of flattening implies a less progress of alloying whereas a higher degree of flattening would detract from shapability.

The atmosphere used in the MA or MG treatment is generally argon gas although a nitrogen gas atmosphere, an argon gas atmosphere containing a small amount of hydrogen, and air may be used.

During the MA or MG treatment, a solid lubricant is desirably added to the metal or alloy starting material(s) in an amount of about 0.1 to 5% by weight, more desirably about 0.1 to 3% by weight, especially about 0.3 to 2% by weight. Less than 0.1% of solid lubricant would be ineffective for its purpose, allowing the once ground material to agglomerate again. Too much amounts of solid lubricant would promote excessive flattening and invite insufficient binder removal which results in blisters. The solid lubricants used herein include stearic acid, salts and derivatives thereof, and wax. Exemplary salts and derivatives of stearic acid are zinc stearate, stearic acid amine and stearamide. SN WAX® commercially available from Sun Nopco Co. is a typical example of wax.

Also carbon is desirably added to the metal or alloy starting material(s) during the MA or MG treatment in an amount of up to about 0.5% by weight, more desirably about 0.05 to 0.3% by weight. This carbon serves for not only the same action as the solid lubricant during MA or MG treatment, but also the action to be described later during firing. The carbon used herein may be amorphous carbon such as carbon black and soot and have a mean particle size of 0.1 to 50 μm.

To the powder which has been MA or MG treated is added a binder, preferably in an amount of about 1 to 3% by weight. With the aid of binder, the powder is shaped into a compact of desired shape, preferably under a pressure of about 4 to 8 ton/cm$^2$.

The compact is fired. The firing includes a binder removal step and a firing step which includes a heating step, a temperature holding step, and a cooling step. Desired conditions for these steps are shown below.

Binder removal step

Heating rate: 50°-500° C./hr., especially 100°-300° C./hr. Holding temperature: 400°-600° C., especially 500°-550° C. Holding time: ½-3 hours, especially 1-2 hours Firing step Heating rate: 100°-600° C./hr., especially 300°-400° C./hr. Holding temperature: 1100°-1350° C., especially 1200°-1300° C. Holding time: ½-10 hours, especially 2-5 hours Cooling rate: 200°-600° C./hr., especially 300°-400° C./hr.

According to the method of the invention, the compact can be fired at relatively low temperatures as compared with the conventional firing step using a holding temperature of about 1200° to 1400° C.

The firing atmosphere is a reducing atmosphere for at least a portion of the time span extending from the point in a later stage of the heating step when a temperature of 1,050° C. is reached to the end of the subsequent temperature holding step. An inert atmosphere is used for the remaining time regions before and after said portion.

The reducing atmosphere may be an atmosphere containing at least 1% by volume of $H_2$ gas or an ammonia decomposed gas atmosphere containing at least 10% by volume of $H_2$ gas. An atmosphere of 100% $H_2$ gas is also acceptable. A higher concentration of $H_2$ gas will be more effective for removing carbon. The inert atmosphere is, for example, nitrogen gas, argon gas or vacuum. The inert atmosphere should have an oxygen partial pressure of less than $10^{-2}$ Torr.

As mentioned above, the firing process includes a binder removal step and a firing step which includes heat treatment in an inert atmosphere and heat treatment in a reducing atmosphere. The heat treatment in an inert atmosphere is effective for removing oxygen through reaction between C and O and the subsequent heat treatment in a reducing atmosphere is effective for removing excess carbon through reaction between C and $H_2$. Deoxygenation contributes to an increased density of sintered body. The carbon participating in the reaction between C and O is that carbon intentionally added upon MA or MG treatment.

A switch from the inert atmosphere to the reducing atmosphere is performed after a temperature of 1,050° C. has been reached in a later stage of the heating step. A premature switch to the reducing atmosphere would be less effective for carbon removal.

EXAMPLE

Examples of the present invention are given below by way of illustration and not by way of limitation. Unless otherwise stated, all percents are by weight.

Example 1: Fe-6.5Si system

A reduced iron powder and a ferrosilicon powder, both commercially available, were weighed so as to give a final composition: Fe-6.5% Si alloy. Both the iron and ferrosilicon powders had a mean particle size of 150 μm. The powder blend, to which 0.5% by weight of stearic acid was added as a solid lubricant, was subject to mechanical alloying for 30 minutes in a dry attritor. The MA treated powder was measured by DSC to find a broadening of the Fe Curie point width from 20° C. to 60° C. (defined as a half-value width of a DSC differential curve), indicating at least partial alloying of Si to Fe. The Fe powder had an average thickness to major length ratio of . The MA treated powder was compacted under a pressure of 8 ton/cm$^2$ into a toroidal shape for magnetic measurement.

Figure 2:
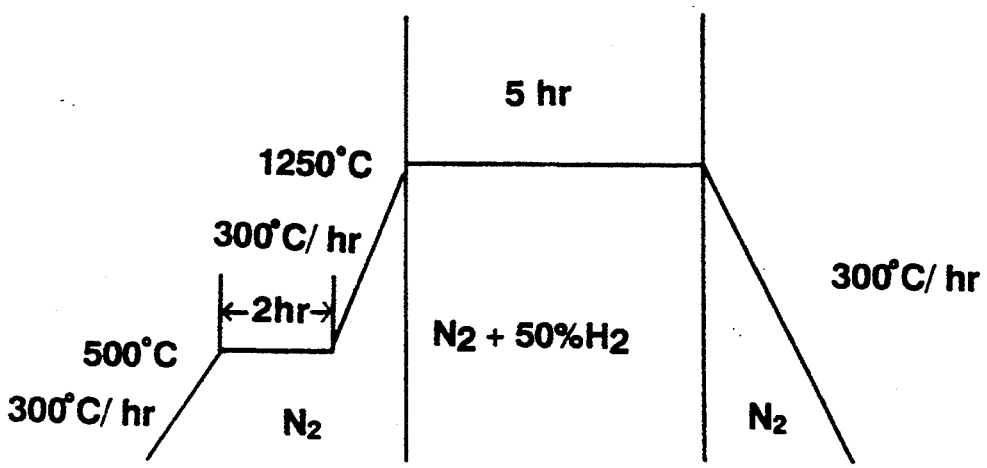
FIG. 2 is a time chart illustrating another exemplary firing temperature profile according to the present invention.

The compacts were fired according to the firing schedules shown in FIGS. 1 and 2, obtaining sintered body samples, Nos. 1 and 2, respectively, within the scope of the invention. The sintered body samples were measured for magnetic properties under an applied magnetic field of 25 Oe. The results are shown in Table 1.

Following the same procedure as sample Nos. 1 and 2 except that 0.1% by weight of carbon black was added during MA treatment, there were prepared sintered body samples, Nos. 3 and 4 within the scope of the invention. These sintered body samples were also measured for magnetic properties under an applied magnetic field of 25 Oe. The results are shown in Table 1.

Following the same procedure as sample Nos. 1 and 2 except that 0.2% by weight of carbon black was added during MA treatment, there were prepared sintered body samples, Nos. 5 and 6 within the scope of the invention. These sintered body samples were also measured for magnetic properties under an applied magnetic field of 25 Oe. The results are shown in Table 1.

Note that in sample Nos. 2 to 6 after mechanical alloying, Fe had a Curie point width of 30° to 60° C. and the Fe particles had a thickness to major length ratio of 1/200to 1/10.

Following the same procedure as sample Nos. 1 and 2 except that the powder was fired without MA treatment, there were prepared sintered body samples, Nos. 7 and 8 outside the scope of the invention. These sintered body samples were also measured for magnetic properties under an applied magnetic field of 25 Oe. The results are shown in Table 1.

For all these samples, density was determined by measuring the outer diameter, inner diameter and thickness of the sample by a micrometer, calculating the volume, and dividing the weight by the volume. The density is also shown in Table 1.

TABLE 1

| Sample No. | C (wt %) | Firing schedule | $B_{25}$ (kG) | Hc (Oe) | Density (g/cm$^3$) |
|---|---|---|---|---|---|
| 1 | 0 | FIG. 1 | 13.0 | 0.46 | 7.25 |
| 2 | 0 | FIG. 2 | 13.0 | 0.45 | 7.20 |
| 3 | 0.1 | FIG. 1 | 13.2 | 0.38 | 7.30 |
| 4 | 0.1 | FIG. 2 | 13.4 | 0.37 | 7.30 |
| 5 | 0.2 | FIG. 1 | 13.8 | 0.19 | 7.32 |
| 6 | 0.2 | FIG. 2 | 13.6 | 0.35 | 7.40 |
| 7* | 0.2 | FIG. 1 | 12.0 | 0.55 | 7.00 |
| 8* | 0.2 | FIG. 2 | 12.0 | 0.55 | 6.98 |

*comparison

The samples within the scope of the invention show an increased density and an increased magnetic flux density (B) by virtue of MA treatment, a reduced content of oxygen in the sintered body due to deoxygenation involved in the firing step, and improved coercivity (Hc).

Example 2: Fe-0.6P system

A reduced iron powder and a ferrophosphorus alloy powder, both commercially available, were weighed so as to give a final composition: Fe-0.6% P alloy. Both the iron and ferrophosphorus powders had a mean particle size of 150 μm. The powder blend, to which 0.5% by weight of stearic acid was added as a solid lubricant, was subject to mechanical alloying for 30 minutes in a dry attritor. The MA treated powder was compacted under a pressure of 8 ton/cm$^2$ into a toroidal shape for magnetic measurement.

The compacts were fired according to the firing schedule shown in FIG. 1, obtaining a sintered body sample, No. 11 within the scope of the invention. The sintered body sample was measured for magnetic properties under an applied magnetic field of 25 Oe. The results are shown in Table 2.

Following the same procedure as sample No. 11 except that 0.1% and 0.2% by weight of carbon black were added during MA treatment, there were prepared sintered body samples, Nos. 12 and 13 within the scope of the invention. These sintered body samples were also measured for magnetic properties under an applied magnetic field of 25 Oe. The results are shown in Table 2.

Note that in sample Nos. 11 to 13 after mechanical alloying, Fe had a Curie point width of 30° to 50° C. and the Fe powder had a thickness to major length ratio of 1/200to 1/10.

Following the same procedure as sample No. 11 except that the powder was fired without MA treatment, there was prepared a sintered body sample, No. 14 outside the scope of the invention. This sintered body sample was also measured for magnetic properties under an applied magnetic field of 25 Oe. The results are shown in Table 2.

For all these samples, density was determined as in Example 1, with the results shown in Table 2.

TABLE 2

| Sample No. | C (wt %) | Firing schedule | $B_{25}$ (kG) | Hc (Oe) | Density (g/cm$^3$) |
|---|---|---|---|---|---|
| 11 | 0 | FIG. 1 | 16.5 | 0.60 | 7.72 |
| 12 | 0.1 | FIG. 1 | 17.0 | 0.43 | 7.78 |
| 13 | 0.2 | FIG. 1 | 16.6 | 0.48 | 7.70 |
| 14* | 0.2 | FIG. 1 | 16.0 | 0.85 | 7.55 |

*comparison

The data of Table 2 show that Example 2 has a similar tendency to Example 1.

Example 3:Fe-13Cr system

A reduced iron powder and a ferrochromium alloy powder, both commercially available, were weighed so as to give a final composition: Fe-13% Cr alloy. Both the iron and ferrophosphorus powders had a mean particle size of 150 μm. The powder blend, to which 0.5% by weight of stearic acid was added as a solid lubricant, was subject to mechanical alloying for 15 minutes in a vessel mill. The MA treated powder was compacted under a pressure of 8 ton/cm$^2$ into a toroidal shape for magnetic measurement.

Figure 3:
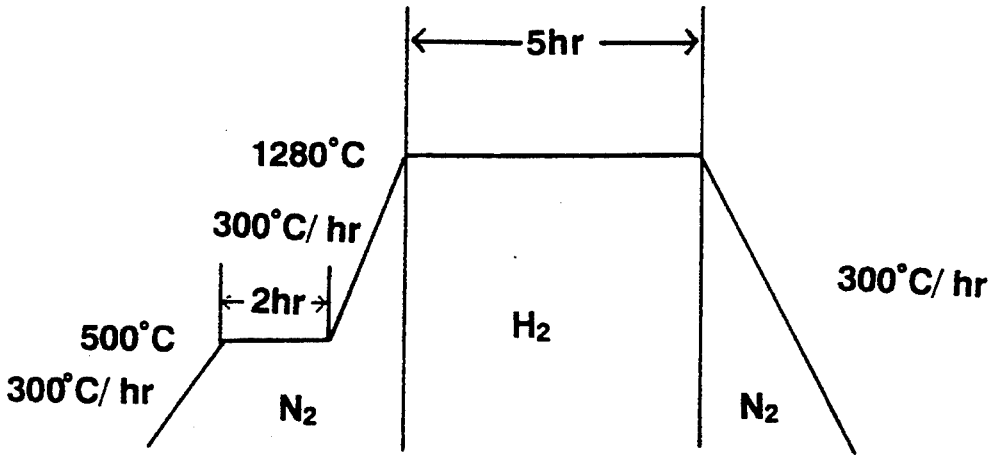
FIG. 3 is a time chart illustrating a further exemplary firing temperature profile according to the present invention.

The compact was fired according to the firing schedule shown in FIG. 3, obtaining a sintered body sample, No. 21 within the scope of the invention. The sintered body sample was measured for magnetic properties under an applied magnetic field of 25 Oe. The results are shown in Table 3. Note that Fe had a Curie point width of 30° to 60° C. and the Fe powder had a thickness to major length ratio of 1/150to 1/10after mechanical alloying.

Following the same procedure as sample No. 21 except that the powder was fired without MAtreatment, there was prepared a sintered body sample, No. 22 outside the scope of the invention. This sintered body sample was also measured for magnetic properties, with the results shown in Table 3.

For these samples, density was determined as in Example 1, with the results shown in Table 3.

TABLE 3

| Sample No. | C (wt %) | Firing schedule | $B_{25}$ (kG) | Hc (Oe) | Density (g/cm$^3$) |
|---|---|---|---|---|---|
| 21 | 0 | FIG. 3 | 13.3 | 0.89 | 7.52 |
| 22* | 0 | FIG. 3 | 11.0 | 1.60 | 7.30 |

*comparison

The data of Table 3 show that Example 3 has a similar tendency to Example 1.

Example 4: Fe-50Ni system

To a commercially available water atomized Fe-50% Ni alloy powder were added 0.5% by weight of stearic acid as a solid lubricant and 0.2% by weight of carbon black. The powder was subject to mechanical grinding for 30 minutes in a dry attritor for inducing internal strain. The mechanically ground powder was compacted into a toroidal shape for magnetic measurement. The compact was fired according to the firing schedule shown in FIG. 2, obtaining a sintered body sample, No. 31 within the scope of the invention. The sintered body sample was measured for magnetic properties under an applied magnetic field of 25 Oe. The results are shown in Table 4.

Following the same procedure as sample No. 31 except that the powder was fired without MG treatment, there was prepared a sintered body sample, No. 32 outside the scope of the invention. This sintered body sample was also measured for magnetic properties, with the results shown in Table 4.

For these samples, density was determined as in Example 1, with the results shown in Table 4.

TABLE 4

| Sample No. | C (wt %) | Firing schedule | $B_{25}$ (kG) | Hc (Oe) | Density (g/cm$^3$) |
|---|---|---|---|---|---|
| 31 | 0.2 | FIG. 2 | 14.0 | 0.10 | 8.05 |
| 32* | 0.2 | FIG. 2 | 12.6 | 0.25 | 7.66 |

*comparison

The data of Table 4 show that Example 4 has a similar tendency to Example 1.

Example 5: Fe-50Co system

To a commercially available water atomized Fe-50% Co alloy powder was added 0.5% by weight of stearic acid as a solid lubricant. The powder was subject to mechanical grinding for 30 minutes in a vessel mill for inducing internal strain. The mechanically ground powder was compacted into a toroidal shape for magnetic measurement. The compact was fired according to the firing schedule shown in FIG. 3, obtaining a sintered body sample, No. 41 within the scope of the invention. The sintered body sample was measured for magnetic properties under an applied magnetic field of 25 Oe. The results are shown in Table 5.

Following the same procedure as sample No. 41 except that the powder was fired without MG treatment, there was prepared a sintered body sample, No. 42 outside the scope of the invention. This sintered body sample was also measured for magnetic properties, with the results shown in Table 5.

For these samples, density was determined as in Example 1, with the results shown in Table 5.

TABLE 5

| Sample No. | C (wt %) | Firing schedule | $B_{25}$ (kG) | Hc (Oe) | Density (g/cm$^3$) |
|---|---|---|---|---|---|
| 41 | 0 | FIG. 3 | 23.0 | 1.0 | 8.1 |
| 42* | 0 | FIG. 3 | 17.5 | 2.5 | 7.8 |

*comparison

The data of Table 5 show that Example 5 has a similar tendency to Example 1.

According to the method of the invention, there are obtained iron system soft magnetic sintered bodies having an increased density and excellent magnetic properties.

Japanese Patent Application No. 195337/1993 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A method for preparing an iron system soft magnetic sintered body comprising the steps of:

blending an iron powder with at least one metal powder selected from metals to be alloyed with iron and ferroalloys so as to give a desired chemical composition, treating the blend by a mechanical alloying process, thereby alloying at least a portion of the metal with iron, shaping the blend into a compact, and firing the compact into an iron system soft magnetic sintered body, wherein the treatment by a mechanical alloying process is effected in the presence of a solid lubricant, and the solid lubricant is added in an amount of 0.1 to 5% by weight of the blend.

2. The method of claim 1 wherein said chemical composition is selected from the group consisting of a Fe-Si system containing 2 to 7% by weight of silicon, a Fe-P system containing 0.2 to 1% by weight of phosphorus, a Fe-Cr system containing 10 to 20% by weight of chromium, a Fe-Co system containing 25 to 60% by weight of cobalt, a Fe-Co-V system containing 25 to 60% by weight of cobalt and 0.5 to 5% by weight of vanadium, a Fe-Ni system containing 30 to 60% by weight of nickel, and a Fe-Ni-Mo system containing 70 to 85% by weight of nickel and 0.5 to 5% by weight of molybdenum.

3. The method of claim 1 wherein the iron powder consists of iron particles flattened by a mechanical alloying process.

4. The method of claim 3 wherein the iron particles have a thickness to major length ratio of 1/500to 1/5as measured by SEM observation.

5. The method of claim 1 wherein the solid lubricant is selected from the group consisting of stearic acid, salts and derivatives thereof, and wax.

6. The method of claim 1 wherein the firing step includes a heating step and a temperature holding step, the firing is effected in a reducing atmosphere for at least a portion of the time span from the point in a later stage of the heating step when a temperature of 1,050° C. is reached to the end of the temperature holding step and in an inert atmosphere in a time region of the heating step prior to said portion.

7. The method of claim 6 wherein the reducing atmosphere contains at least 1% of $H_2$.

8. The method of claim 6 wherein the reducing atmosphere is an ammonia decomposed gas atmosphere containing at least 10% of $H_2$.

9. A method for preparing an iron system soft magnetic sintered body comprising the steps of:

treating an iron system alloy powder of a desired chemical composition by a mechanical grinding process, shaping the powder into a compact, and firing the compact into an iron system soft magnetic sintered body, wherein the treatment by a mechanical grinding process is effected in the presence of a solid lubricant, and the solid lubricant is added in an amount of 0.1 to 5% by weight of the powder.

10. The method of claim 9 wherein said chemical composition is selected from the group consisting of a Fe-Si system containing 2 to 7% by weight of silicon, a Fe-P system containing 0.2 to 1% by weight of phosphorus, a Fe-Cr system containing 10 to 20% by weight of chromium, a Fe-Co system containing 25 to 60% by weight of cobalt, a Fe-Co-V system containing 25 to 60% by weight of cobalt and 0.5 to 5% by weight of vanadium, a Fe-Ni system containing 30 to 60% by weight of nickel, and a Fe-Ni-Mo system containing 70 to 85% by weight of nickel and 0.5 to 5% by weight of molybdenum.

11. The method of claim 9 wherein the solid lubricant is selected from the group consisting of stearic acid, salts and derivatives thereof, and wax.

12. The method of claim 9 wherein the firing step includes a heating step and a temperature holding step, the firing is effected in a reducing atmosphere for at least a portion of the time span from the point in a later stage of the heating step when a temperature of 1,050° C. is reached to the end of the temperature holding step and in an inert atmosphere in a time region of the heating step prior to said portion.

13. The method of claim 12 wherein the reducing atmosphere contains at least 1% of $H_2$.

14. The method of claim 12 wherein the reducing atmosphere is an ammonia decomposed gas atmosphere containing at least 10% of $H_2$.

15. A method for preparing an iron system soft magnetic sintered body comprising the steps of:

blending an iron powder with at least one metal powder selected from metals to be alloyed with iron and ferroalloys so as to give a desired chemical composition, treating the blend by a mechanical alloying process, thereby alloying at least a portion of the metal with iron, shaping the blend into a compact, and firing the compact into an iron system soft magnetic sintered body, wherein amorphous carbon is added in an amount of up to 0.5% by weight of the blend before or during the treatment by a mechanical alloying process.

16. The method of claim 15 wherein the carbon is in powder form having a mean particle size of up to 50 μm.

17. An iron system soft magnetic sintered body prepared by the method of any one of claims 1, 2, 3, 4, 5, 6, 7, 8, 15, and 16.

18. A method for preparing an iron system soft magnetic sintered body comprising the steps of:

treating an iron system alloy powder of a desired chemical composition by a mechanical grinding process, shaping the powder into a compact, and firing the compact into an iron system soft magnetic sintered body, wherein amorphous carbon is added in an amount of up to 0.5% by weight of the powder before or during the treatment by a mechanical grinding process.

19. The method of claim 18 wherein the carbon is in powder form having a mean particle size of up to 50 μm.

20. An iron system soft magnetic sintered body prepared by the method of any one of claims 9, 10, 11, 12, 12, 14, 18, and 19.

* * * * *

UNITED STATES PATENT AND TRADEMARK OFFICE

CERTIFICATE OF CORRECTION

PATENT NO. : 5,443,787

DATED : August 22, 1995

INVENTOR(S) : Teruo MORI et al.

It is certified that error appears in the above-identified patent and that said Letters Patent is hereby corrected as shown below:

Column 12, line 8, "12, 14, 18, and 19." should read

--13, 14, 18, and 19.--

Signed and Sealed this

Eighteenth Day of June, 1996

*Attest:*

Bruce Lehman

BRUCE LEHMAN

*Attesting Officer*

*Commissioner of Patents and Trademarks*